United States Patent [19]

Buljan et al.

[11] Patent Number: 4,804,231

[45] Date of Patent: Feb. 14, 1989

[54] POINT ATTACK MINE AND ROAD MILLING TOOL WITH REPLACEABLE CUTTER TIP

[75] Inventors: Sergej-Tomislav Buljan, Acton; Vinod K. Sarin, Lexington, both of Mass.

[73] Assignee: GTE Laboratories Incorporated, Waltham, Mass.

[21] Appl. No.: 747,604

[22] Filed: Jun. 24, 1985

[51] Int. Cl.[4] ..... E21C 35/18

[52] U.S. Cl. ..... 299/91; 175/410

[58] Field of Search ..... 175/410; 299/79, 86, 299/91, 92, 93; 403/343, 307

[56] References Cited

U.S. PATENT DOCUMENTS

| | | | |
|---|---|---|---|
| 874,455 | 12/1907 | Swanton et al. | 175/410 |
| 3,807,804 | 4/1974 | Kniff | 299/91 |
| 3,932,952 | 1/1976 | Helton et al. | 37/142 R |
| 4,199,035 | 4/1980 | Thompson | 175/410 |

FOREIGN PATENT DOCUMENTS

| | | | |
|---|---|---|---|
| 191267 | 1/1964 | Sweden | 175/410 |

*Primary Examiner*—Jerome W. Massie
*Assistant Examiner*—David J. Bagnell
*Attorney, Agent, or Firm*—Ivan L. Ericson

[57] ABSTRACT

A cutter bit holder which can be used as a point attack mine tool and a road milling tool is described. The cutter bit holder has a replaceable cutter tip which can be replaced in the field when the cutter tip is worn by unscrewing the flange from the shank of the holder and replacing the worn cutter tip with a new one.

1 Claim, 1 Drawing Sheet

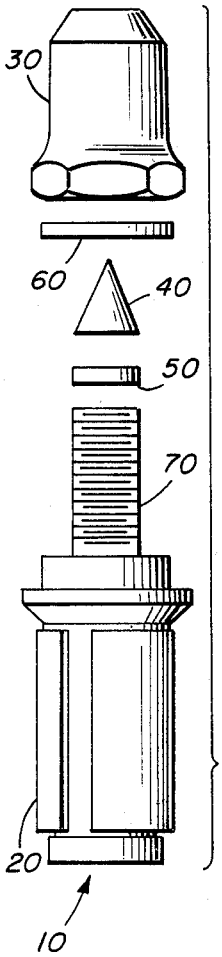
FIG. 2
FIG. 3
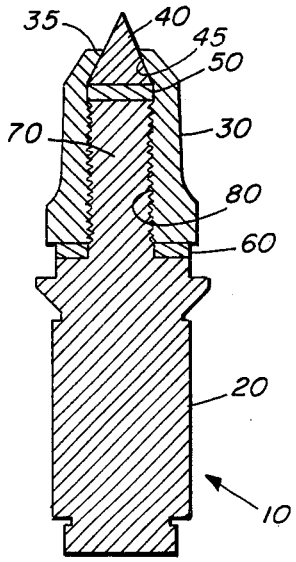
FIG. 1 PRIOR ART
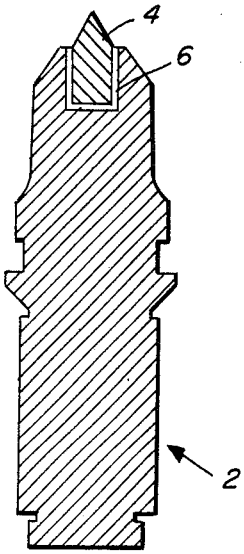
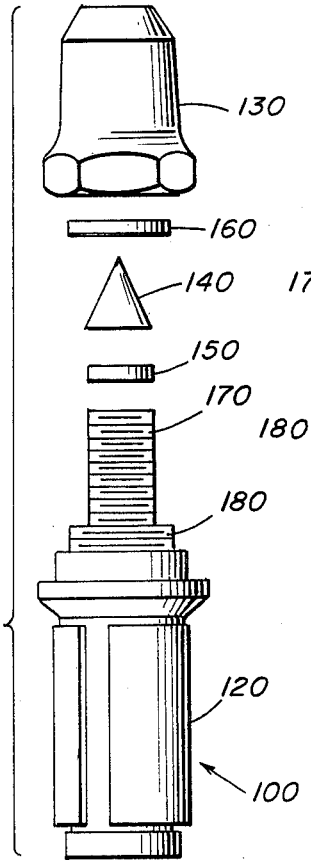
FIG. 4
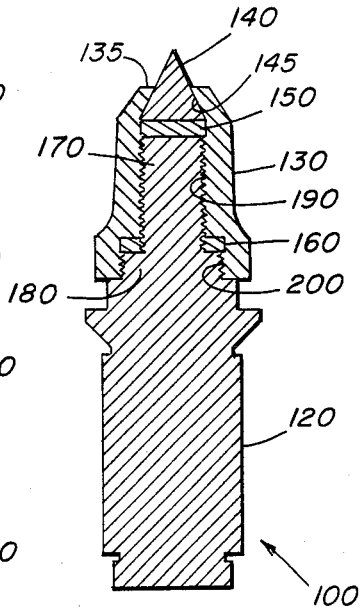
FIG. 5

POINT ATTACK MINE AND ROAD MILLING TOOL WITH REPLACEABLE CUTTER TIP

FIELD OF THE INVENTION

This invention relates to tools. More particularly, it relates to point attack mine and road milling tools with removable bits.

BACKGROUND OF THE INVENTION

Commonly point attack mine and road milling tools are so designed to necessitate brazing of the cutter tip at the end of the tool in appropriately provided cavity. This method requires that brazing alloys be compatible with steel shank and cutter tip material, to wet both materials and to provide good bond without deterioration of material properties. Low brazing temperatures are needed in order not to anneal heat treated steel shanks. In that manner a cutter tip is permanently attached to the shank.

Disadvantages of this method are higher manufacturing costs (cost of brazing alloy plus processing), the need for development of new brazing alloys for each new cutter tip material and the fact that removal of the damaged tip is more costly than discarding the whole assembly which prevents its replacement.

OBJECT OF THE INVENTION

Accordingly it is an object of the present invention to provide an improved point attack mine and road milling tool design which would allow tip replacement in the field. It is another object of this invention to provide an improved cutter tip holder which eliminates brazing.

Further and other objects of the present invention will become apparent from the description contained herein.

SUMMARY OF THE INVENTION

In accordance with one aspect of this invention, a new and improved cutter bit holder is provided. The new and improved cutter bit holder comprises a flange member, a shank member, and a replaceable cutter tip. The shank member has a male threaded shank portion. The flange member has a length, a first end portion and an axial passageway traversing the length of the flange member. The axial passageway has a tapered first portion and a female threaded second portion. The tapered first portion diverges toward the first end portion of the flange member. The replaceable cutter tip is positioned inside the first end portion of the axial passageway of the flange member extending partially beyond the first end portion of the flange member. The replaceable cutter tip is contiguous with the tapered first portion of said axial passageway of the flange member. The male threaded shank portion of the shank member is continuous with the female threaded second portion of the axial passageway of the flange member. The removable cutter tip is held in position by a coacting the shank member and the flange member.

BRIEF DESCRIPTION OF THE DRAWING

In the drawing:

FIG. 1 is a cross sectional view of a prior art cutter bit holder.

FIG. 2 is an exploded view of a cutter bit holder in accordance with the present invention.

FIG. 3 is a cross sectional view of the cutter bit holder shown in FIG. 2.

FIG. 4 is an exploded view of another embodiment of a cutter bit in accordance with the present invention.

FIG. 5 is a cross sectional view of the cutter bit holder shown in FIG. 4.

For a better understanding of the present invention, together with other and further objects, advantages and capabilities thereof, reference is made to the following disclosure and appended claims in connection with the above-described drawing.

DETAILED DESCRIPTION OF THE INVENTION

FIG. 1 illustrates a typical prior art cutter bit holder 2 which has a cutter tip 4 attached to the end of holder 2 by a braze 6. Cutter tip 4 can not be easily replaced in the field.

FIG. 2 illustrates a cutter bit holder 10 of the present invention. Holder 10 has shank 20, a flange 30, a replaceable cutter tip 40, an absorption pad 50 and a lock washer 60. Shank 20 has a male threaded shank portion 70. Flange 30 has a length, a first end portion 35, and an axial passageway traversing the length of flange 30. The axial passageway has a tapered first portion 45, and a female threaded second portion 80 depicted in FIG. 3. Tapered first portion 45 diverges toward first end portion 35 of flange 30. Replaceable cutter tip 40 is positioned inside tapered first portion 45 of the axial passageway of flange 30 extending partially beyond the first end portion 35 of flange 30. Replaceable cutter tip 40 is contiguous with tapered first portion 45 of axial passageway of flange 30. Male threaded shank portion 70 of shank 20 is contiguous and coacting with female threaded second flange portion 80 of the axial passageway of flange 30 as depicted in FIG. 3. Replaceable cutter tip 40 is held in position by a coacting of shank 20 and flange 30.

To assemble cutter bit holder shank 20 is screwed into flange 30 with replaceable cutter 40, lock washer 60, and absorption pad 50 positioned as depicted in FIG. 3. Lock washer 60 locks shank 20 into flange 30 thereby preventing replaceable cutter tip 40 from coming loose during operation.

Another embodiment of the present invention is depicted in FIGS. 4 and 5.

FIG. 4 illustrates a cutter bit holder 100 of the present invention. Holder 100 has a shank 120, a flange 130, a replaceable cutter tip 140, and absorption pad 150 and a lock washer 160. Shank 120 has a male threaded first shank portion 170 and a threaded second male shank portion 180. Male threaded first shank portion 170 has a first diameter. Male threaded second shank portion 180 has a second diameter which is larger than the first diameter of male threaded first shank portion 170. Flange 130 has a length, a first end portion 135, and an axial passageway traversing the length of flange 130. The axial passageway has a tapered first portion 145, female threaded second portion 190, and female threaded third portion 200 as depicted in FIG. 5. Tapered first portion 145 diverges toward first end portion 135 of flange 130. Replaceable cutter tip 140 is positioned inside tapered first portion 145 of the axial passageway of flange 130 extending partially beyond first end portion 135 of flange 130. Male threaded first shank portion 170 of shank 120 is contiguous and coacting with female threaded second flange portion 190 of the axial passageway of flange 130 and male threaded second shank portion 180 of shank 120 is contiguous and coacting with female threaded third flange portion 200 of axial passageway of flange 130 as depicted in FIG. 5. Replaceable cutter tip 140 is held in position by a coacting of shank 120 and flange 130. Male threaded second portion 180 having a larger cross sectional area than male threaded first shank portion 170 provides more strength to holder 100 thereby increasing the resistance to shear forces while in operation.

To assemble cutter bit holder 100 shank 120 is screwed into flange 130 with replaceable cutter 140, lock washer 160, and absorption pad 150 positioned as depicted in FIG. 5. Lock washer 160 locks shank 120 into flange 130 thereby preventing replaceable cutter tip 140 from coming loose during operation.

The present invention enables an operator to replace worn replaceable cutter tips 40, 140 in the field and reusing the cutter bit holders 10, 100 thereby reducing the overall cost of operation. In addition the present invention uses cutter tips 40, 140 having a reduced volume compared to standard cutter tip 4 as depicted in FIG. 1 which further reduces the cost of operation.

Replaceable cutter tips 40, 140 can be made of any material sufficient to withstand the applications of a point attack mine tool or a road milling tool, such as cemented tungsten carbide. The portion of the cutter tips 40, 140 extended beyond the first end portions 35, 135 can have various geometries as required for a given application.

The cutter bit holders 10, 100 can be used with or without absorption pads 50, 150 depending upon the particular application. When the absorption pads are not used, cutter bit holders 10, 100 will have to be modified to account for their removal.

Another embodiment of the present invention is a design in which the threaded male and female portions of the flange and the shank can be replaced by tapered portions whereby the securing of the removable cutter tip can be accomplished by press-fitting.

While there has been shown and described what is at present considered the preferred embodiment of the invention, it will be obvious to those skilled in the art that various changes and modifications may be made therein without departing from the scope of the invention as defined by the appended claims.

What is claimed is:

1. A point attack mine and road milling tool cutter bit holder comprising a flange member, a shank member, and a replaceable cutter tip; said shank member having a male threaded first shank portion and a male threaded second shank portion; said male threaded first shank portion having a first diameter and said male threaded second shank portion having a second diameter; said first diameter being less than said second diameter; said flange member having a length, a first end portion, and an axial passageway traversing said length of said flange member; said axial passageway having a tapered first portion, a female threaded second portion, and a female threaded third portion, said tapered first portion diverging toward said first end portion of said flange member; said cutter tip being positioned inside said tapered first portion of said axial passageway of said flange member extending partially beyond said first end portion of said flange member; said replaceable cutter tip being contiguous with said tapered first portion of said axial passageway of said flange member; said male threaded first shank portion of said shank member being contiguous and coacting with said female threaded second flange portion of said axial passageway of said flange member and said male threaded second shank portion of said shank member being contiguous with said female threaded third flange portion of said axial passageway of said flange member; said tapered replaceable cutter tip being held in position by a coacting of said shank member and said flange member; said male threaded second shank portion having a larger cross sectional area than said male threaded first shank portion providing more strength to said cutter bit holder to resist shear forces during operation.

* * * * *